US010533735B1

(12) United States Patent
Sokhanvari et al.

(10) Patent No.: US 10,533,735 B1
(45) Date of Patent: Jan. 14, 2020

(54) BREAKING AN ELECTRICAL CONNECTION BEFORE LOWERING A LIGHTING FIXTURE OR OTHER ELECTRICITY POWERED APPARATUS FROM A REMOTE DISTANCE SUCH AS A CEILING

(71) Applicants: Alireza Sokhanvari, Valencia, CA (US); Nima Ostad, Tarzana, CA (US)

(72) Inventors: Alireza Sokhanvari, Valencia, CA (US); Nima Ostad, Tarzana, CA (US)

( * ) Notice: Subject to any disclaimer, the term of this patent is extended or adjusted under 35 U.S.C. 154(b) by 0 days.

(21) Appl. No.: 16/409,086

(22) Filed: May 10, 2019

(51) Int. Cl.

| | |
|---|---|
| ***F21V 21/38*** | (2006.01) |
| ***F21S 8/06*** | (2006.01) |
| ***F21V 21/008*** | (2006.01) |
| ***F21V 21/03*** | (2006.01) |

(52) U.S. Cl.
CPC ..... *F21V 21/38* (2013.01); *F21S 8/06* (2013.01); *F21V 21/008* (2013.01); *F21V 21/03* (2013.01)

(58) Field of Classification Search
CPC ..... F21V 21/008; F21V 21/03; F21V 21/08; F21S 8/06
See application file for complete search history.

(56) References Cited

U.S. PATENT DOCUMENTS

| | | | | |
|---|---|---|---|---|
| 5,105,349 | A | 4/1992 | Falls et al. | |
| 7,033,048 | B2 | 4/2006 | Sin | |
| 7,410,150 | B1 * | 8/2008 | Falls | B66D 1/56 248/329 |
| 8,733,985 | B2 | 5/2014 | Storm | |
| 9,175,835 | B2 | 11/2015 | Machiorlette | |

FOREIGN PATENT DOCUMENTS

| | | | |
|---|---|---|---|
| CN | 207849160 | U | 9/2018 |

* cited by examiner

*Primary Examiner* — Thomas M Sember
(74) *Attorney, Agent, or Firm* — Thomas I. Rozsa

(57) ABSTRACT

An electricity disconnect apparatus adapted for use with a housing which has the electrical connection inside/at a ceiling or exposed electrically connected device such as a baffle which contains a socket which can be electrically disconnected from the electrical connection of the housing so that the baffle and a source of illumination such as a lightbulb contained therein can be lowered. The lowering of the baffle and an electrical disconnection from the hardwired electricity in the ceiling enables the baffle and lightbulb to be lowered by a pulley cable system. The electrical disconnect and pulley and cable system enable the baffle and source of illumination to be lowered so that it can be reached by a person standing on the floor.

5 Claims, 8 Drawing Sheets

BREAKING AN ELECTRICAL CONNECTION BEFORE LOWERING A LIGHTING FIXTURE OR OTHER ELECTRICITY POWERED APPARATUS FROM A REMOTE DISTANCE SUCH AS A CEILING

BACKGROUND OF THE INVENTION

Field of the Invention

Ceiling lighting figures are hot wired to electrical wiring in the ceiling which in turn is wired to an electrical source of power. Changing a lightbulb requires a person engaging in a dangerous activity of standing on a tall ladder. Changing a lightbulb or other electrical work to be performed while the fixture is still wired is a dangerous activity.

The present invention relates to the field of an apparatus which facilitates safely changing a lightbulb or performing electrical work on a ceiling lighting fixture which is eight or more feet above the floor of the room from which the ceiling lighting fixture is located. While using a lighting fixture as an example, it is within the spirit and scope of the present invention to also have the work performed on any apparatus which is in a high location and is powered by electricity and requires lowering to ground level for work to be performed on it.

Description of the Prior Art

The following five patents are the closest prior art known to the inventor which relate to the subject of the present invention:

1. U.S. Pat. No. 5,105,349 issued to John W. Falls et al. on Apr. 14, 1992 for "Motorized Chandelier Lift System";
2. U.S. Pat. No. 7,033,048 issued to Jeong-Hoon Sin on Apr. 25, 2006 for "Equipment for Highly Mounted Lamp Having Ascending and Descending Function";
3. U.S. Pat. No. 8,733,985 issued to Greg Lyle Storm on May 27, 2014 for "Horizontally and Vertically Mountable Fixture Extension that Can Be Lowered for Service";
4. U.S. Pat. No. 9,175,835 issued to Steven C. Machiorlette on Nov. 3, 2015 for "Pendant Light Fixture and Support Stud";
5. Chinese Patent Publication No. CN207849160U published on Sep. 11, 2018 for "An Improved Collapsible Ceiling Lamp".

SUMMARY OF THE INVENTION

The present invention is an electricity disconnect apparatus adapted for use with a housing which has the electrical connection inside the ceiling and then a baffle which contains a socket which can be electrically disconnected from the electrical connection of the housing so that the baffle and a source of illumination such a lightbulb contained therein can be lowered. For example, the baffle is in a high ceiling and it is dangerous to climb a ladder or otherwise gain access in order to change the lightbulb. The innovation of the present invention enables the lowering of the baffle and an electrical disconnection from the hard wired electricity in the ceiling so that the baffle and lightbulb can be lowered to a distance where it can be reached by anyone standing on the floor and simply disconnect the lightbulb and replace it with a new lightbulb without running the risk of an electrical shock.

It is also within the spirit and cope of the present invention to have an electrical disconnect of any other apparatus which is powered by electricity and is hot wired to a source of electricity and requires lowering from a ceiling height so that the apparatus can be repaired or replaced. This includes, but is not limited to, other apparatuses such as a surveillance camera, a sound speaker and a smoke detector.

It is an object of the present invention to provide a novel apparatus to disconnect a ceiling fixture from electrical wiring in the ceiling to provide a safe fixture which is lowered to a level where a person standing on the ground can replace a lightbulb or make other safe adjustments to the ceiling lighting fixture.

It is another object of the present invention to incorporate a pair of cables when lowering a ceiling fixture to the ground to reduce the possibility of the cables becoming entangled. In prior art embodiments using a single cable, the cable may twist and turn and become entangled.

It is also an object of the present invention to employ the basic principles of the electrical disconnect apparatus of the present invention to disconnect the source of power to any other ceiling apparatus such as a surveillance camera, a sound speaker, or a smoke detector so that it can be safely lowered to the ground without being electrically powered while the electricity portion remains in the ceiling so that a person can safely make the appropriate change or modification in the electrically powered apparatus without risking the risk of shock or electrocution.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention includes three major innovative components. The first major innovation are components which cause the lighting fixture retaining a source of illumination such as a baffle with a socket or plug which retains a lightbulb to be disconnected from wires leading to a source of electricity. The second major innovation is having two cables, instead of one, provide balance and eliminate twisting of the cables as the electrical assembly is raised back to the ceiling after appropriate repairs or replacement have been made. The third innovation is a wraparound cable balance springs which provide enough upward movement once the electrical conducting element touches a first magnet electric conducting piston and therefore the apparatus can continue its rotation until an electrical connection is reestablished.

Figure 1:
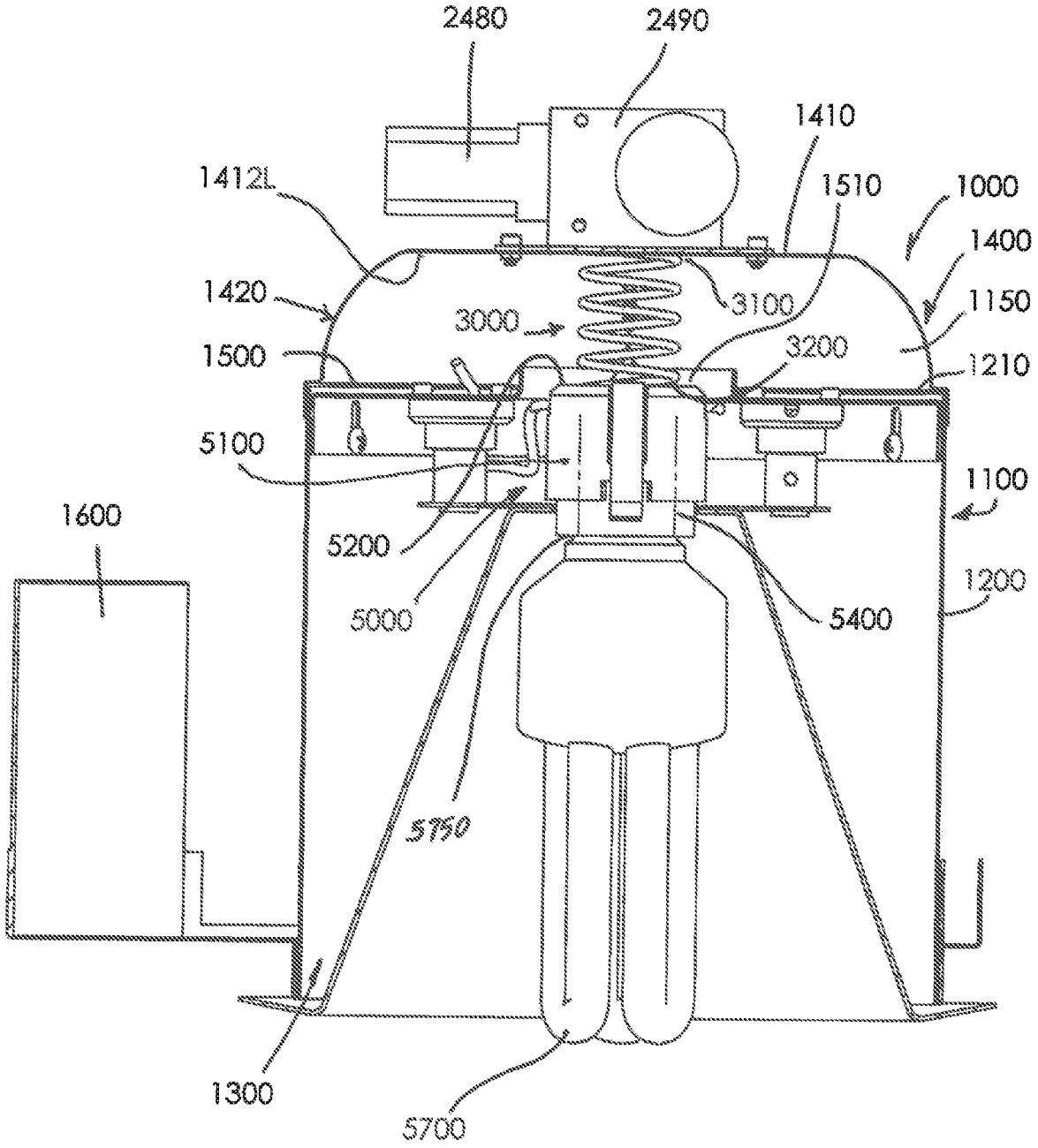
FIG. 1 is an illustration of a side perspective partially transparent cross-sectional view of the present invention electrical assembly with all components in a connected state within a canister of an illumination fixture.

The first example which will be discussed is a source of illumination wherein the present invention electrical disconnect apparatus is employed. Referring to FIG. 1, there is illustrated in a side perspective partially transparent view an example of an entire housing which includes the present invention illustrating in the fully assembled configuration with the electrical socket electrically connected to the source of electricity from the structure. A housing 1000 is affixed inside a ceiling. The housing 1000 includes a canister 1100 having a cylindrical sidewall 1200 with an open bottom 1300 and a top section 1400 including a flat top wall 1410 with a rounded sidewall 1420 affixed to the cylindrical sidewall 1200 at a top 1210 of the cylindrical sidewall 1200. A separation plate 1500 is affixed at the junction where the top section 1400 is affixed to cylindrical sidewall 1200. The separation plate 1500 has a central transverse opening 1510. The components as illustrated in FIG. 1 will now be described in detail in the following figures.

Figure 2:
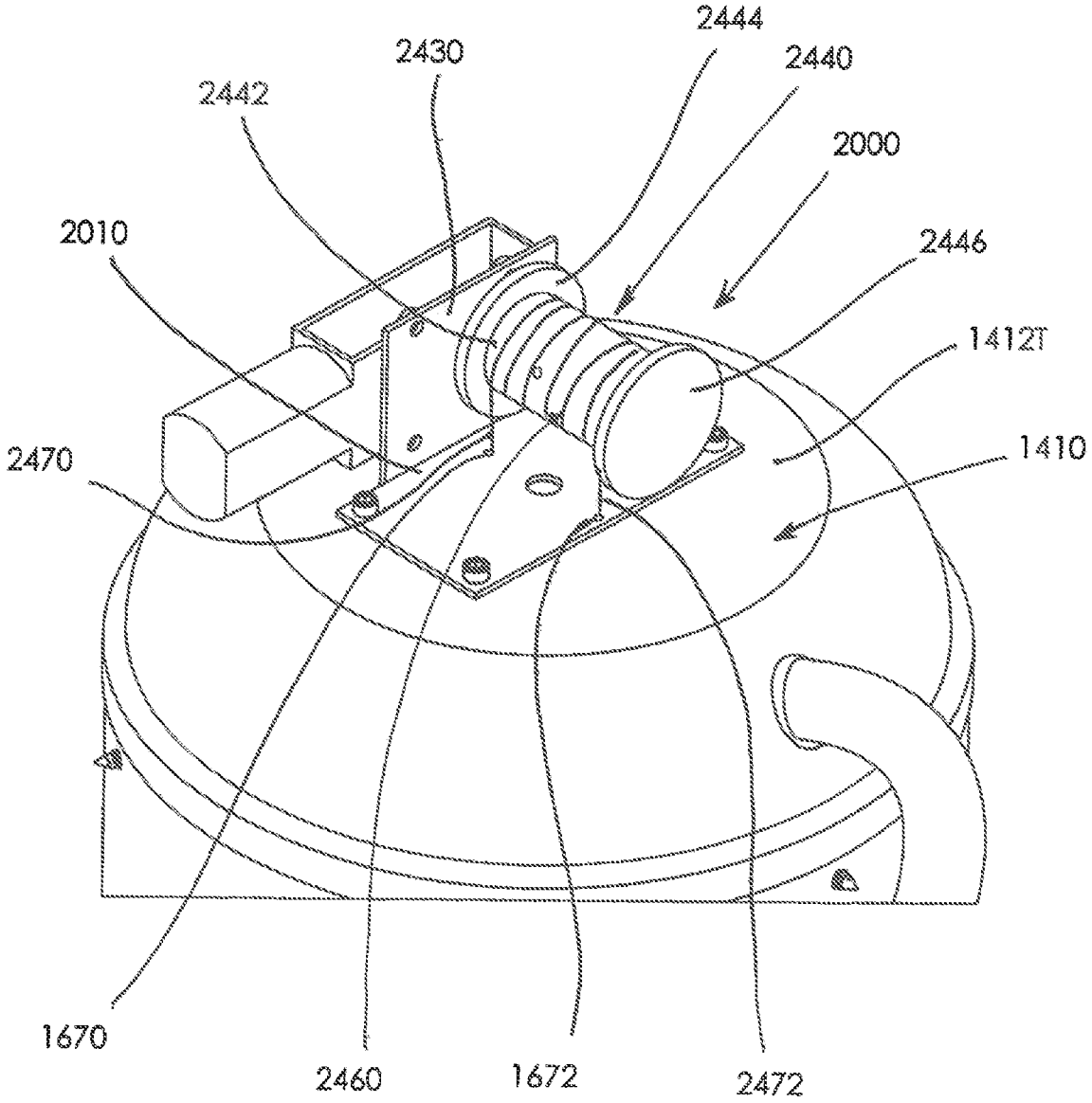
FIG. 2 is a top perspective view of the winch assembly including a motor and locking gear box and a pulley system with a cable wrapped around a pullet drum and having two ends extending into an illumination fixture housing.

Referring to FIG. 2, there is illustrated a top perspective view of the electrical winch and pulley system with an automatic locking mechanism (hereafter when combined is referred to as ("winch 2000"). The winch 2000 includes a plate 2010 by which it is affixed to the top surface 1412T of flat top wall 1410, as also illustrated in FIG. 1. A vertical separation plate 2430 is affixed to plate 2010. The vertical separation plate 2430 includes a pulley 2440 having a drum 2442 with a first drum sidewall 2444 and second drum sidewall 2446 rotatably supporting a drum 2442. A cable 2460 is wound on the drum 2442 and having a cable first end 2470 extending through opening 1670 and a cable second end 2472 extending through opening 1672. Openings 1670 and 1672 extending through plate 2010 and top surface 1412T of flat top wall 1410 and into the interior 1150 of canister 1100. The winch 2000 includes an electric motor 2480 and a lockable gear box 2490. When activated by a remote signal, the electric motor 2480 causes the pulley drum 2442 to rotate in a first direction, such as counterclockwise, enabling cable ends 2470 and 2472 to move further downward and out of the interior 1150 of canister 1100 as will be described. When the motor 2480 is used to stop the rotation through a remote signal, the lockable gear box 2490 locks the cable ends 2470 and 2472 to prevent further downward movement of the cable ends 2470 and 2472 which are then suspended in the air. When a reverse signal is sent to the electric motor 2480, the pulley drum 2442 rotates in the opposite direction, such as clockwise, the cable ends 2470 and 2472 are elevated as the cable is rewound on the pulley drum 2442.

Further referring to FIG. 1, centrally positioned within canister top section 1400 and affixed to lower surface 1412L of top wall 1410 is central main compression spring 3000. The central main compression spring 3000 is affixed at its top end 3100 to lower surface 1412L and top wall 1410. The lower end 3200 of central main compression spring 3000 is compressed against the top surface 5200 of the lamp socket 5100 of the socket fixture 5000. In its initial state, main compression spring 3000 is compressed. Both the main compression spring 3000 and the top surface 5200 and a small portion of the lamp socket 5100 of socket fixture 5000 extend through opening 1510 of central separation plate 1500.

Figure 5:
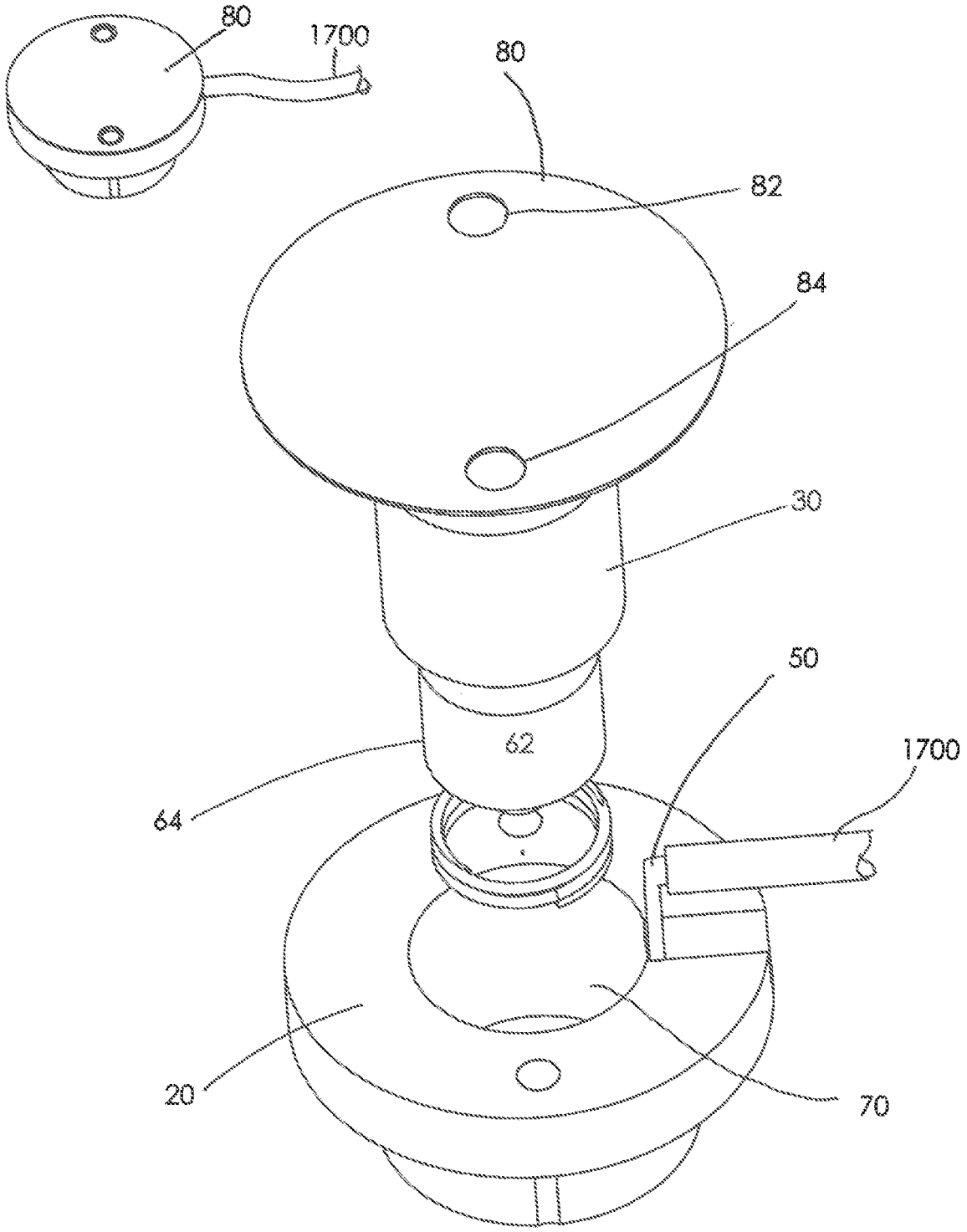
FIG. 5 is a top perspective view of the top a non-electrical conducting material housing and an exploded view of the upper fixed components of the present invention.

Referring to FIG. 5, there is illustrated a top perspective view of the top of a non-electrical conducting material housing 20 and an exploded view of the upper affixed components of the present invention. There is illustrated two openings 82 and 84 through which affixing members are passed to attach the isolator 80 to separation plate 1500. Also illustrated is electrical cable 1700 including a "hot" wire 50 extending through the non-conducting material housing 20, to a non-magnetic electricity conducting cylindrical member 30 which by way of example only is a copper bushing.

Figure 4:
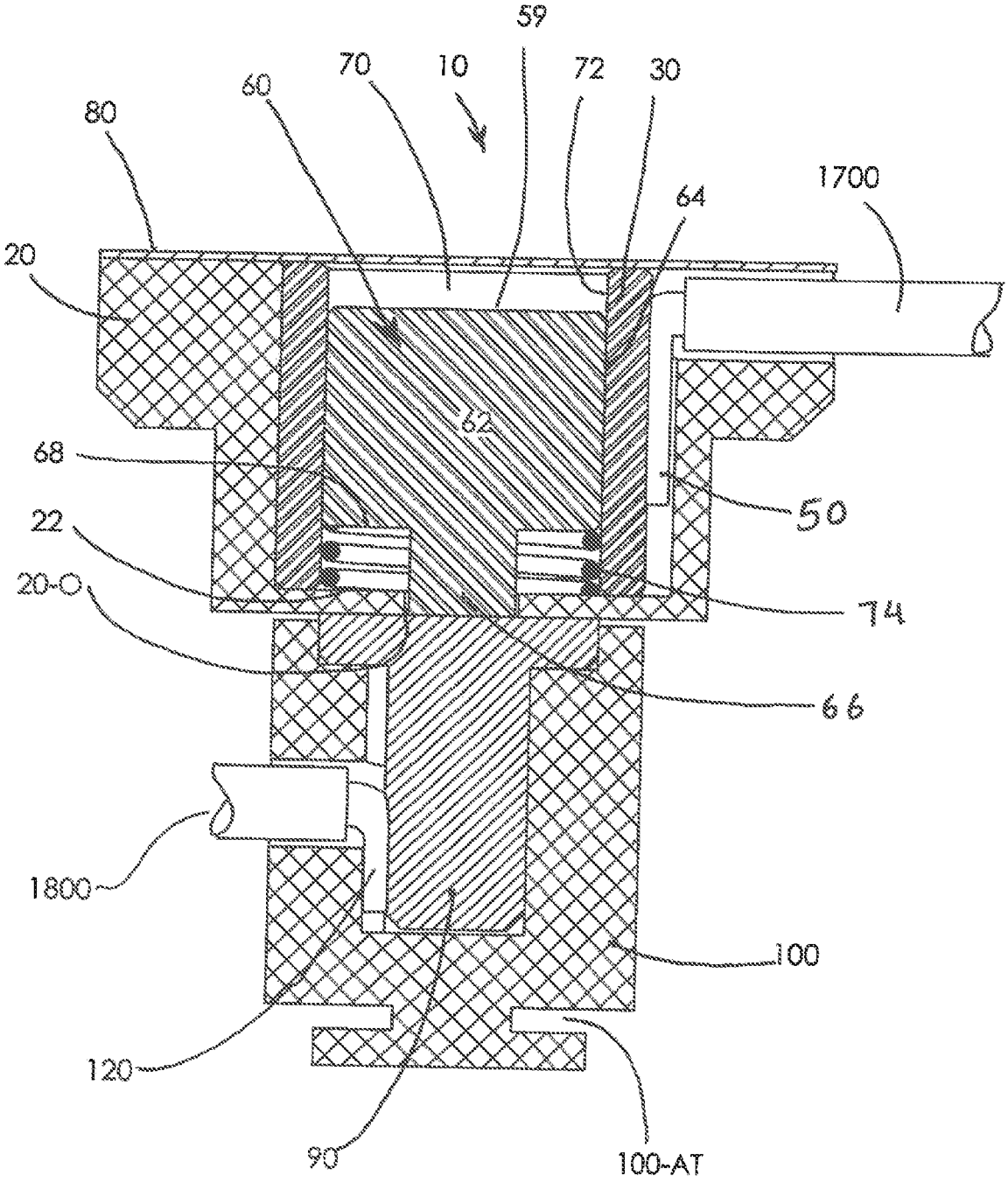
FIG. 4 is a cross-sectional view of the electrical connection of the present invention in a connected condition.

Referring to FIG. 4, the "hot" wire 50 extends from the cable 1700 and is in electrical contact with the non-magnetic electricity conducting cylindrical member 30. The "hot" wire 50 is pinched between the non-electricity conducting member 20 (which is material such as Teflon®) and the non-magnetic electricity conducting cylindrical member 30. The non-magnetic electricity conducting cylindrical member 30 surrounds an interior chamber 70 which retains a magnetic electricity conducting piston 60 having a body 62 with a sidewall 64 and a central post 66 which extends downwardly from bottom surface 68 of magnetic electricity conducting piston 60. The chamber 70 is surrounded by a portion of the non-electrical conducting material housing 20 on the bottom with an opening 20-O to enable central post 66 to pass through. The top of the chamber 70 is covered by an isolator 80 made of non-electricity conducting material and the sidewall is surrounded by non-magnetic electricity conducting cylindrical member 30. The chamber 70 includes an interior open space 72 between the top surface 59 of body 62 and isolator 80. A piston spring 74 surrounds central post 66 is between bottom surface 68 and a chamber interior surface 22 of non-electrical conducting material housing 20.

The movable portion includes a lower non-electrical conducting material housing 100 which surrounds a lower housing interior chamber 120 which retains a T-shaped electricity conducting permanent magnet 90. A second cable 1800 includes a "passive" wire which extends through sidewall 110 of lower non-electrical conducting material housing 100 and is in electrical contact with T-shaped electricity conducting permanent magnet 90 and is electrically connected to the socket assembly at its opposite end.

Figure 7:
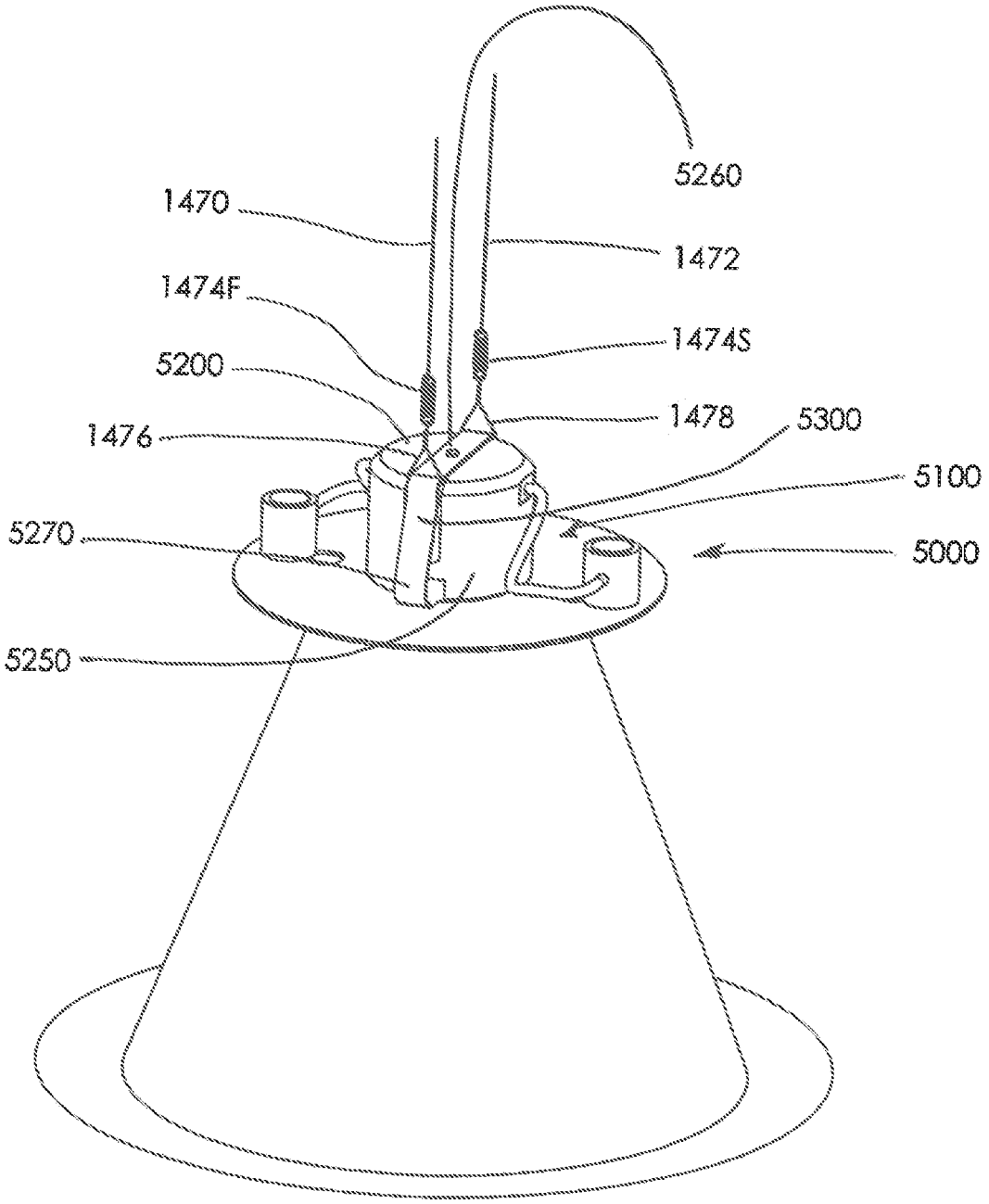
FIG. 7 is a top-side perspective view of the metal plate with the lamp socket extending above and affixed to the metal plate, also illustrating both active and passive movable portions of the present invention affixed to the metal plate and illustrating the cable ends affixed to the lamp socket.

Referring to FIG. 7, there is illustrated a top-side perspective view of the metal plate with the lamp socket extending above and affixed to the metal plate, also illustrating both active and passive movable potions of the present invention affixed to the metal plate and illustrating the cable ends affixed to the lamp socket. The lamp socket 5100 has an exterior sidewall 5250. A spring clip member 5300 is affixed to the top surface 5200 of lamp socket 5100 by an affixing member such as rivet 5260 and spring clip member 5300 extends along sidewall 5250 and terminates in a first end 5270 and a second end 5272 (see FIG. 8).

Figure 8:
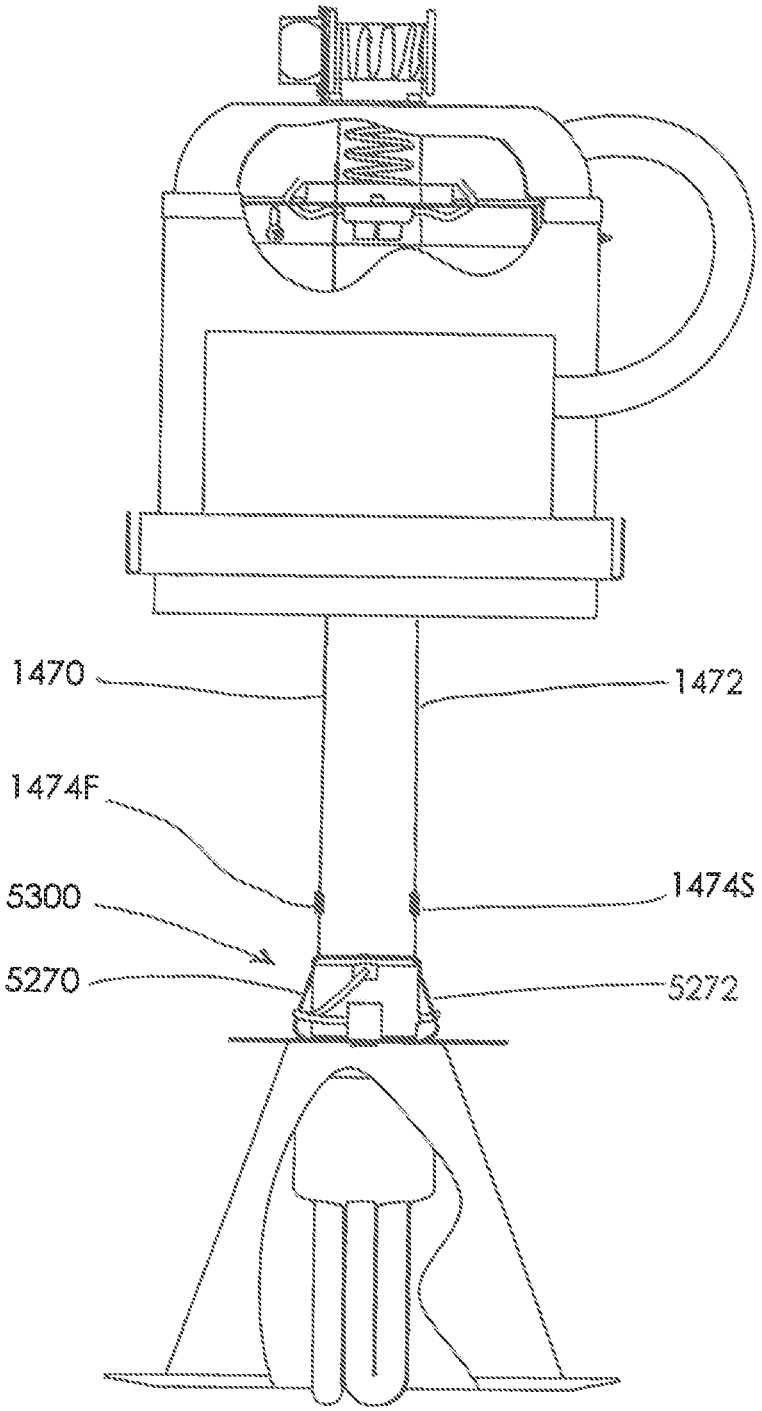
FIG. 8 is a side perspective view of the activated present invention with the lighting fixture lowered away from the ceiling.

Referring to FIGS. 7 and 8, first cable end 1470 includes a first wrap around balancing spring 1474F adjacent its distal end 1476 which distal end 1476 in turn is wrapped around and affixed to the spring clip member 5300 along the side adjacent first end 5270. Second cable end 1472 includes a second wrap around balancing spring 1474S adjacent its distal end 1478 which distal end 1478 in turn is wrapped around and affixed to the spring clip member 5300 along the side adjacent second end 5272. Referring to FIG. 1, the interior of lamp socket 5100 includes a interior threads 5400 (shown in dashed lines) which receives a light bulb 5700 through its threaded end 5750. (Also see FIG. 3).

Figure 3:
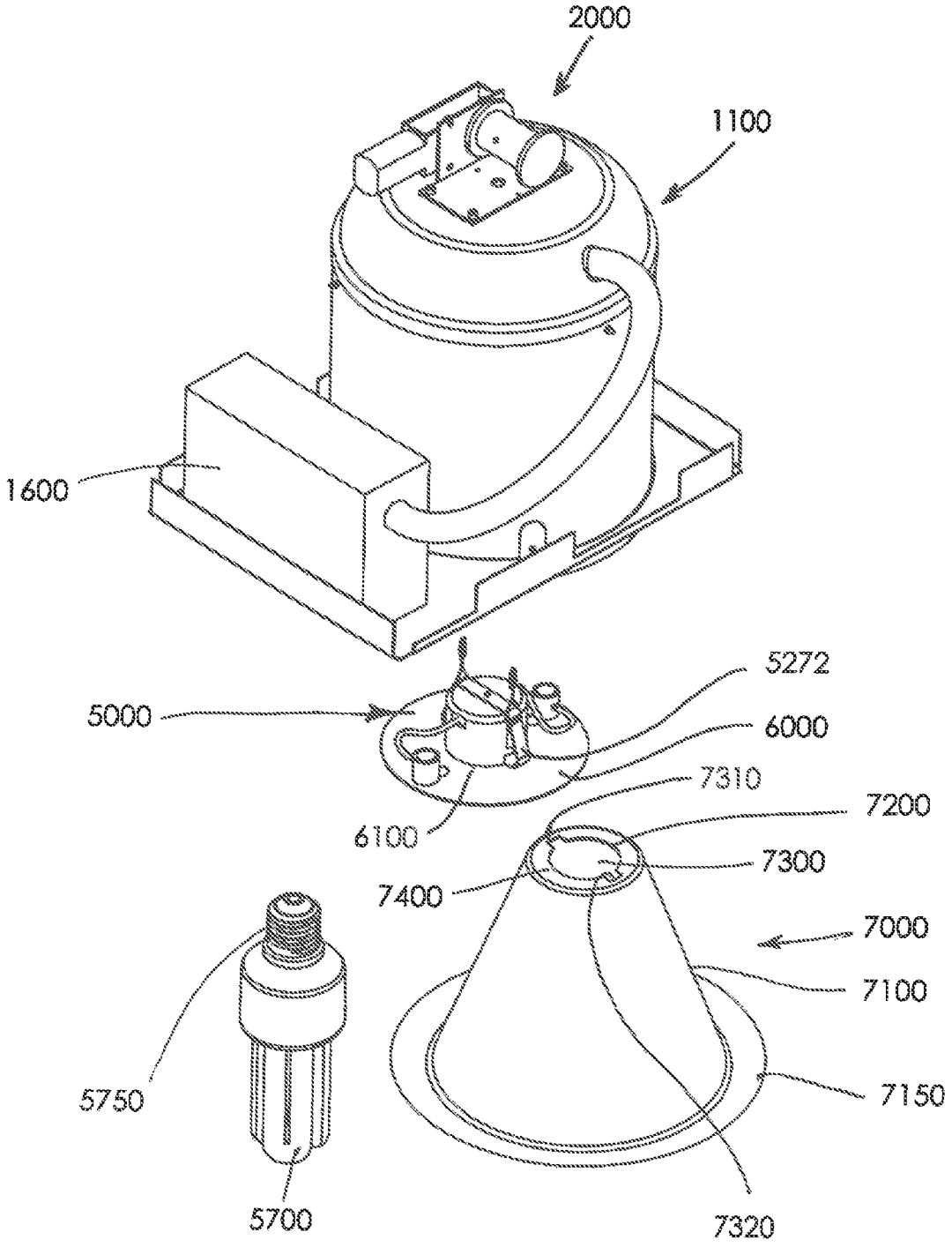
FIG. 3 is an exploded view of a portion of the ceiling fixture canister and electrical connection to a junction box and a portion of the metal plate and lamp socket lowered from the canister, and an exploded view of the baffle and lightbulb.

Referring to FIGS. 3 and 7, there is illustrated an exploded view and a top side perspective view of some of the components of the present invention. The housing canister 1100 and winch 2000 have already been described. The socket assembly 5000 has been described. The socket assembly 5000 extends through an opening 6100 in a metal plate 6000. The frustum-shaped baffle 7000 includes a conical sidewall 7100 ending in a trim 7150 at the front or distal end of the baffle 7000. The baffle 7000 has a top wall 7200 with a central opening 7300 with a pair of mating openings, first mating opening 7310 and second mating opening 7320 oppositely disposed on interior circumference 7400 of central opening 7300. First clip end 5270 is retained in first mating opening 7310 and second clip end 5272 is retained in second mating opening 7320 to retain the socket assembly 5000 into baffle 7000.

The pulley system 2000, main compression spring 3000, cables affixed to the socket assembly, and the balancing springs on the cables are all integral to the present invention electrical circuit connection breaking assembly 10. But the key innovative feature is set forth below. Referring to FIG. 4, there is illustrated a cross-sectional view of the present invention electrical circuit breaking assembly 10 in the connected mode. As previously discussed, the housing includes the steel plate 1500 within canister 1100 with a non-electrical conducting material housing 20 with attaching members to affix the non-conducting housing to the steel plate (this is discussed when referring to FIG. 5). An electrical cable 1700 including a "hot" wire 50 extends from the junction box 1600. Through the top section 1400 into the interior 1150 of canister 1100 and through the non-conducting housing 20, to a non-magnetic electricity conducting cylindrical member 30 which by way of example only is a copper bushing.

The "hot" wire 50 extends from the cable 1700 and is in electrical contact with the non-magnetic electricity conducting cylindrical member 30. The "hot" wire 50 is pinched between the non-electricity conducting member 20 (which is material such as Teflon®) and the non-magnetic electricity conducting cylindrical member 30. The non-magnetic electricity conducting cylindrical member 30 surrounds an interior chamber 70 which retains a magnetic electricity conducting piston 60 having a body 62 with a sidewall 64 and a central post 66 which extends downwardly from bottom surface 68 of magnetic electricity conducting piston 60. The chamber 70 is surrounded by a portion of the non-electrical conducting material housing 20 on the bottom with an opening 20-O to enable central post 66 to pass through. The top of the chamber 70 is covered by an isolator 80 made of non-magnetic electricity conducting material and the sidewall is surrounded by non-magnetic electricity conducting cylindrical member 30. The chamber 70 includes an interior open space 72 between the top surface 59 of body 62 and isolator 80. A piston spring 74 surrounds central post 66. The piston spring 74 is between bottom surface 68 and a chamber interior surface 22 of non-electrical conducting material housing 20.

Figure 6:
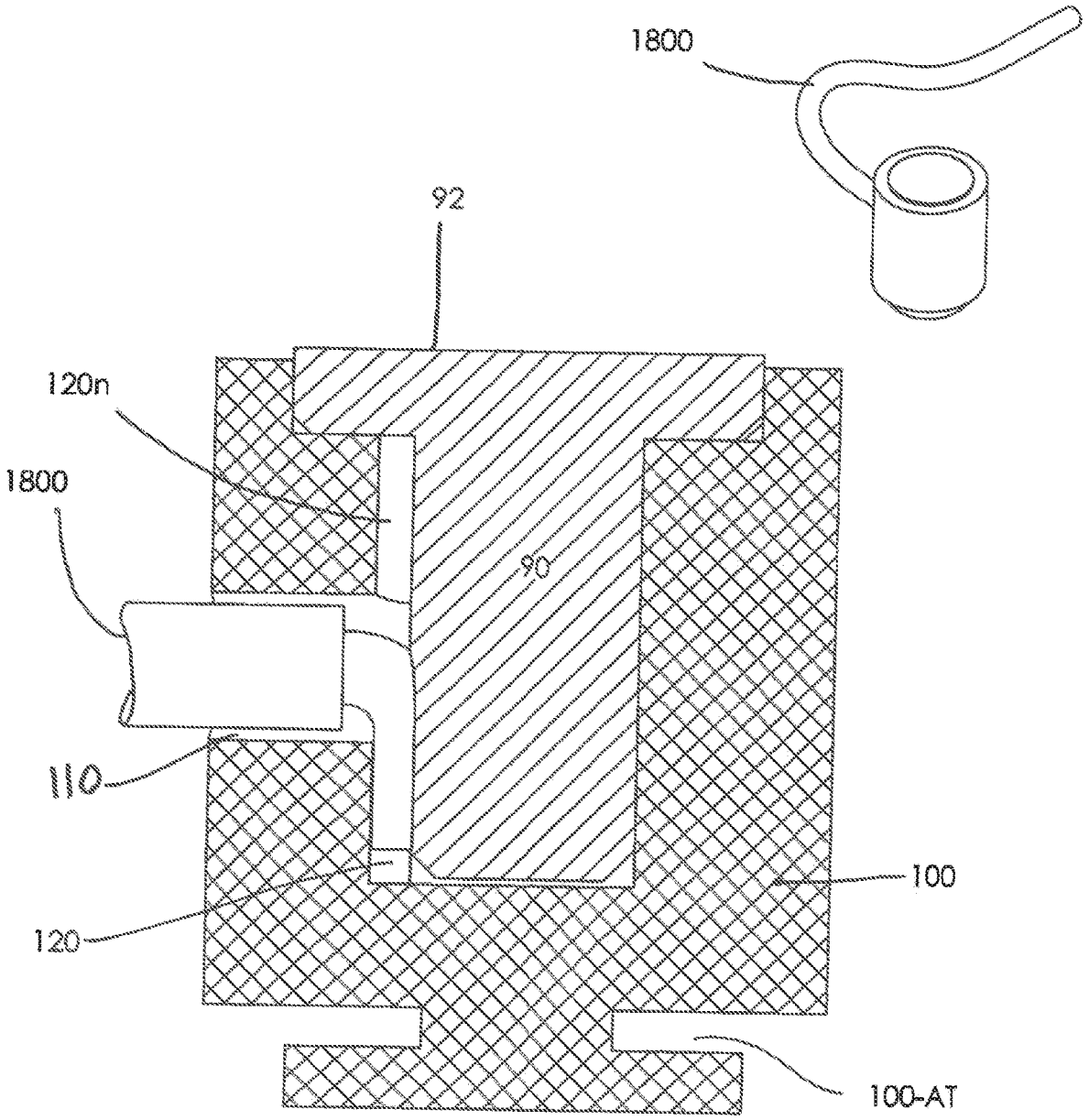
FIG. 6 is a cross-sectional view of the movable components of the present invention.

In addition, further referring to FIG. 6 in addition to FIG. 4, the movable portion includes a lower non-electrical conducting material housing 100 which surrounds a lower housing interior chamber 120 which retains a T-shaped electricity conducting magnet 90. A second cable 1800 extends through a sidewall opening 110 of lower non-electrical conducting material housing 100. The second cable 1800 includes a "hot" wire connected to lamp socket 5100. The lower non-electrical conducting material housing 100 includes an attaching member 100-AT which is used to attach lower non-electrical conducting material housing 100 to the metal plate connected to the socket housing 5000.

Referring to FIG. 5, there is illustrated an top exploded perspective view of the top a non-electrical conducting material housing 20 as illustrated in cross-section in FIG. 6. There are illustrated two openings 82 and 84 through which affixing members are passed to attach the isolator 80 to separation plate 1500. Also illustrated is the electrical cable 1700 including a "hot" wire 50 extending through the non-conducting material housing 20, to non-magnetic electricity conducting cylindrical member 30 which by way of example only is a copper bushing.

The "hot" wire 50 extends from the cable 1700 and is in electrical contact with the non-magnetic electricity conducting cylindrical member 30. The "hot" wire 50 is pinched between the non-electricity conducting member 20 (which is material such as Teflon®) and the magnetic electricity conducting cylindrical member 30. The non-magnetic electricity conducting cylindrical member 30 surrounds an interior chamber 70 which retains a magnetic electricity conducting piston 60 having a body 62 with a sidewall 64 and a central post 66 which extends downwardly from bottom surface 68 of magnetic electricity conducting piston 60. The chamber 70 is surrounded by a portion of the non-electrical conducting material housing 20 on the bottom with an opening 20-O to enable central post 66 to pass through. The top of the chamber 70 is covered by an isolator 80 made of non-electricity conducting material and the sidewall is surrounded by non-magnetic electricity conducting cylindrical member 30. The chamber 70 includes an interior open space 72 between the top surface 59 of body 62 and isolator 80. A piston spring 74 surrounds central post 66 is between bottom surface 68 and a chamber interior surface 22 of non-electrical conducting material housing 20.

The movable portion includes a lower non-electrical conducting material housing 100 which surrounds a lower housing interior chamber 120 which retains a T-shaped electricity conducting magnet 90. In the connected position, the top surface 92 of electricity conducting T-shaped magnet 90 is in contact with post 66. A second cable 1800 includes a passive wire when electricity is disconnected which extends through sidewall 110 of lower non-electrical conducting material housing 100 and is in electrical contact with T-shaped electricity conducting magnet 90 and is electrically connected to the socket assembly at its opposite end.

FIG. 8 is a side perspective view of the activated present invention with the lighting fixture lowered away from the ceiling.

To activate the present invention, the winch 2000 is released and the pulley is activated as previously described. The cables begin to lower the metal plate 6000 and socket assembly 5000. The main spring 3000 which is in a state of compression creates a downward force on the lamp socket 5100, the socket assembly 5000, the metal plate 6000, the baffle 7000 and retained bulb 5700. This causes the electricity conducting T-shaped magnet 90 to be disconnected from the post 66 of the electricity conducting piston 60. The piston spring 74 further pushes the electricity conducting piston 60 further upward into chamber 70. This causes the electrical connection between the ferro-magnetic electricity conducting piston 60 and electricity conducting T-shaped magnet 90 to be disconnected. Therefore, the connection to the hot wire 50 from cable 1700 is disconnected. The "hot" portion of hot wire 50, cable 1700 leading to junction box 1600 and electricity conducting piston remain at ceiling level with the "hot" portion remaining in, or connected to the canister 1100. The remaining components affixed to the steel plate 6000 and the non-electricity conducting lower portion affixed to the steel plate 6000 are lowered away. The cable 1800 connected to lamp socket 1800 travels with the steel plate 6000 and is "passive".

The assembly is lowered to a desired level and a signal to the motor 2480 causes the motor to stop. The locking gear box 2490 also locks any further movement and the lower assembly is suspended and supported by the two cables 1470 and 1472.

Therefore, the assembly including the light bulb 5700 can be replaced or other components including the baffle 7000 and trim 7150 can be changed or otherwise lowered so that components can be repaired. With no electrical connection, the work is at ground level so no ladder needs to be used and no risk of electrical shock will occur.

Therefore, through the present invention, the socket assembly 5000 and baffle 7000 are safely lowered away from the ceiling with the electricity disconnected so the bulb can safely be replaced.

For additional clarification, when the motor 2480 is stopped, the winch 2000 is released and there is a spring force in the center that pushes on the socket assembly to give it a downward motion so that the socket assembly along with the baffle, the plate to which it is affixed and which contains the dynamic portion of the electrical disconnect assembly and the baffle and the lighting go down. The disconnect is at the location where the magnet meets the ferro-magnetic electricity conducting piston. The piston spring is there to cause the piston to move upwardly so someone cannot accidently touch the piston 60 because the system is still hot when it is in the ceiling. However, with the electrical disconnect, the magnet and the non-magnetic material and the wiring to the socket are now not hot because the electricity has been disconnected.

FIG. 8 shows the static portion which is now affixed to the canister and does not come down and it is still hot.

After the lightbulb is replaced other work performed, it is time to return the lowered assembly back to the canister 1100. A signal to the motor 2480 causes it to rotates in a reverse direction so the cables ends 2470 and 2472 are rewound on the drum 2442 of pulley 2440.

Having two cables instead of one provides balance and eliminates twisting of the cables as the assembly is raised back to the ceiling. The wraparound cable balancing springs 1474F and 1474S provide enough upward movement once the first T-shaped electrical conductor 90 touches the first magnetic electricity conducting piston 60 and therefore, the drum can continue its rotation until the second T-shaped electrical conductive magnet touches the magnetic electricity conducting piston 60 and completes the circuit.

As the T-shaped electrical conducting magnet 90 draws closer to the post 66 of ferro-magnetic electricity conducting piston 60, the magnetic attraction overcomes the force of piston springs 74 which go into compression and the main spring 3000 compressed by winch 2000 upward motion, When the electricity conducting magnet 90 comes in contact with post 66 of ferro-magnetic electricity conducting piston 60, the electrical contact is restored. The motor 2480 is stopped and the fixture is returned to its normal electrical state.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adapted for use with a source of illumination socket assembly electrically connected to a source of electrical power transmitting electricity through a first cable including at least a "hot" wire, the source of illumination fixture including at least one light bulb, the apparatus comprising:

a. a housing including a canister having a flat top wall, a cylindrical sidewall with an open bottom and a top section including a flat top wall with a rounded sidewall affixed to the cylindrical sidewall at a top of the cylindrical sidewall, a separation plate affixed at a junction where the top section is affixed to the cylindrical sidewall, the separation plate having a central opening;

b. affixed to an exterior surface of the top wall is a winch including an electric motor and an auto locking gear box connected to a pulley having a drum with a first drum sidewall and a second drum sidewall rotatably supporting the drum, a cable is wound on the drum and having a cable first end extending through a first opening in the flat top wall and into an interior chamber of the canister and a cable second end extending through a second opening in the flat top wall and into the interior chamber of the canister, when activated, the electric motor causes the pulley drum to rotate in a first direction, enabling the first and second cable ends to move further downward and out of the interior chamber of the canister, and when the electric motor stops, the lockable gear box locks the first and second cable ends to prevent further downward movement of the first and second cable ends;

c. a central main compression spring is affixed at its's top end to a lower surface of the flat top wall, a lower end of the central main compression spring is compressed against a top surface of a lamp socket of a socket assembly, and in its initial state, the main compression spring and the top surface of the lamp socket extend through the opening in the central separation plate;

d. a non-electrical conducting material housing including an isolator plate attached to the separation plate, an electrical cable including a "hot" wire extending through the non-conducting housing to a magnetic electricity conducting cylindrical member with the "hot" wire extending from the cable and is in electrical contact with the magnetic electricity conducting cylindrical member, the "hot" wire is pinched between the non-electricity conducting member and the non-magnetic electricity conductive cylindrical member, the magnetic electricity conducting cylindrical member surrounds an interior chamber which retains a magnetic electricity conducting piston having a body with a sidewall and a central post which extends downwardly from a bottom surface of magnetic electricity conducting piston, the interior chamber is surrounded by a portion of the non-electrical conducting material housing on the interior chamber bottom with an opening to enable the central post to pass through, a top of the interior chamber is covered by the isolator, the magnetic electricity conducting piston movable within the interior chamber, a piston spring surrounds the central post between the bottom surface of the magnetic electricity conducting piston and a bottom surface of the non-electrical conducting material housing;

e. a movable portion includes a lower non-electrical conducting material housing which surrounds a lower housing interior chamber which retains a T-shaped electricity conducting magnet, a second cable includes a second "hot" wire which extends through a sidewall of the lower non-electrical conducting material housing and is in electrical contact with the T-shaped electricity conducting magnet and is electrically connected to a socket assembly at its opposite end;

f. a metal plate with the lamp socket extending above and affixed to the metal plate, the lamp socket having an exterior sidewall with a spring clip member affixed to the top surface of the lamp socket by an affixing member, the spring clip extends along a first sidewall of the lamp socket and terminates in a first end and the spring clip expends along a second sidewall of the lamp socket and terminates in a second;

g. the first cable end includes a first wrap around balancing spring adjacent its distal end which distal end in turn is wrapped around and affixed to the spring clip member adjacent first clip end, the second cable end includes a second wrap around balancing spring adjacent its distal end which distal end in turn is wrapped around and affixed to the spring clip member adjacent the second clip end; and h. the lamp socket includes interior threads which receive a threaded end of a light bulb, the socket assembly extends through an opening in the metal, a frustum-shaped baffle includes a conical sidewall ending in a trim at its distal end, the frustum-shaped baffle has a top wall with a central opening with a pair of mating openings, first mating opening and second mating opening oppositely disposed on an interior circumference of the central opening, the first clip end is retained in first mating opening and the second clip end is retained in second mating opening to retain the socket assembly into the baffle;

i. when the electric motor is activated, the pulley is then activated to lower the metal plate and socket assembly, the main spring which is in a state of compression creates a downward ejection force on the lamp socket assembly, the metal plate, the baffle and retained light bulb which causes the electricity conducting T-shaped magnet to be disconnected from the post of the electricity conducting piston, the piston spring further pushes the electricity conducting piston further upward into the piston chamber which causes the electrical connection between the magnetic electricity conducting piston and electricity conducting T-shaped magnet to be disconnected, therefore, the connection to the hot wire from the first cable is disconnected, the "hot" portion of hot wire, the first cable leading to a junction box and electricity conducting piston remain at ceiling level with the "hot" portion remaining in, or connected to the canister, the remaining components affixed to the steel plate and the non-electricity conducting lower portion affixed to the steel plate are lowered away to a desired level and the motor stop, the self-locking gear box also locks any further movement and the lower assembly is suspended and supported by the first cable and second cable to facilitate light bulb replacement and baffle repairs and/or replacement; and j. upon reactivation of the motor, the first and second cables are rewound around the drum of the pulley, having two cables instead of one provides balance and reduces twisting of the cables as the assembly is raised back to the ceiling, the wraparound cable balancing springs prevent the fixture from becoming imbalanced and non-level and prevents any twisting to avoid rotation of the metal plate and around the portion containing the T-shaped electrical conducting magnet from being rotated out of proper alignment with the electricity conducting piston, as the T-shaped electrical conducting magnet draws closer to the post of magnetic electricity conducting piston, the magnetic attraction overcomes the force of both the piston spring and the main spring which go into compression, and when the electricity conducting magnet comes in contact with the post of the magnetic electric conducting piston, the electrical contact is restored, the motor is stopped and the fixture is returned to its normal electrical state.

2. An apparatus adapted for use with a source of illumination fixture electrically connected to a source of electrical power transmitting electricity through a first cable including at least a "hot" wire, the source of illumination fixture including at least one light emitting member, the apparatus comprising:

a. a top housing portion including a non-electricity conducting material housing with at least one attaching member to affix the non-electricity conducting housing to said source of illumination fixture;

b. a magnetic electricity conducting cylindrical member with a cylindrical sidewall encircling an interior chamber, the magnetic electricity conducting member within said top housing portion, said first cable extending from said source of illumination fixture through the non-electricity conducting material of said top housing portion with said passive wire in contact with said magnetic electricity conducting cylindrical member, c. said magnetic electricity conducting cylindrical member surrounding a sidewall of an interior chamber which retains a magnetic electricity conducting piston having a body with a sidewall and a central post which extends downwardly from a bottom surface of said magnetic electricity conducting piston, the interior chamber partially surrounded by a portion of the non-electrical conducting material housing on the bottom of the interior chamber with an opening to enable the central post to pass through, a piston spring surrounding said central post and positioned between an interior surface of the non-electricity conducting material housing and the bottom surface of said magnetic electricity conducting piston;

d. the top portion including an isolator made of non-electricity conducting material retaining said non-electricity conducting material housing, the isolator covering a top of said interior chamber, the interior chamber including an interior open space between a top surface of the body of the magnetic electricity conducting piston and an interior surface of said isolator, at least one attaching member attaching the isolator to said illumination fixture;

e. a lower portion of the movable portion including a lower non-electrical conducting material housing which surround a sidewall and bottom of a lower housing interior chamber which retains an electricity conducting magnet, a top surface of electricity conducting magnet is in contact with a bottom surface of said post of said magnetic electricity conducting piston;

f. a second cable extending through a sidewall of said lower non-electrical conducting material housing, the second cable including a passive wire connected to a sidewall of said electricity conducting magnet at one end and the hot wire of the second cable connected to a socket housing said at least one light emitting member, g. when the electricity conducting magnet and the bottom surface of said post of said magnetic electricity conducting piston are in contact, an electrical circuit is closed and the at least one light emitting member is illuminated; and h. a winch and pulley assembly affixed at a location of a fixed housing, the pulley assembly including a cable wrapped around a drum, the cable having two spaced apart ends;

i. wherein, upon activation of a motor from said winch and pulley assembly, the source of illumination fixture is lowered from its location and a force member applies a downward force on the illumination fixture, the contact between the electricity conducting magnet and the bottom surface of said post of said magnetic electricity conducting piston are separated and there is no electricity transmitted to the illumination fixture as it is lowered from a ceiling location, the lower portion traveling with the lowered source of illumination while the upper portion remains affixed to the illumination fixture and is not lowered.

3. An apparatus for breaking an electrical contact from a source of electricity to a source of illumination, the apparatus comprising:

a. a non-electrical conducting material housing, an electrical cable including a passive wire extending from a source of electricity through the non-conducting housing to a magnetic electricity conducting member with the passive wire extending from the cable and is in electrical contact with the magnetic electricity conducting member, the passive wire is pinched between the non-electricity conducting member and the magnetic electricity conducting member, the magnetic electricity conducting cylindrical member surrounds an interior chamber which retains a magnetic electricity conducting piston having a body with a sidewall and a central post which extends downwardly from a bottom surface of magnetic electricity conducting piston, the interior chamber is surrounded by a portion of the non-electrical conducting material housing on the interior chamber bottom with an opening to enable the central post to pass through, a top of the interior chamber is covered by an isolator, the magnetic electricity conducting piston movable within the interior chamber, a piston spring surrounds the central post between the bottom surface of the magnetic electricity conducting piston and a bottom surface of the non-electrical conducting material housing;

b. a movable portion includes a lower non-electrical conducting material housing which surrounds a lower housing interior chamber which retains an electricity conducting magnet, a second cable includes a second hot wire which extends through a sidewall of the lower non-electrical conducting material housing and is in electrical contact with the electricity conducting magnet and is electrically connected to a socket assembly of the illumination fixture at its opposite end;

c. a plate with the illumination fixture extending above and affixed to the metal plate, said movable portion affixed to said plate; and d. when the electricity conducting magnet touches the post of the magnetic electricity conducting piston, the source of illumination is electrically connected to the source of electricity, and when a force causes the electricity conducting magnet to become separated from and not touch the post of the magnetic electricity conducting piston, electrical contact is broken and the source of illumination is not electrically connected to the source of electricity.

4. The apparatus in accordance with a claim 3, wherein the magnetic electricity conducting cylindrical member is a copper bushing and for breaking an electrical contact from a source of electricity to an electrical apparatus, the electrical apparatus comprising a portion of the electricity apparatus.

5. The apparatus in accordance with a claim 3, wherein the non-electrical conducting material housing is made of material selected from the group consisting of plastic and ceramics.

* * * * *